US011220641B2

(12) United States Patent
Patel

(10) Patent No.: US 11,220,641 B2
(45) Date of Patent: Jan. 11, 2022

(54) SANDWICH GASIFICATION PROCESS FOR HIGH-EFFICIENCY CONVERSION OF CARBONACEOUS FUELS TO CLEAN SYNGAS WITH ZERO RESIDUAL CARBON DISCHARGE

(71) Applicant: Nikhil Manubhai Patel, Grand Forks, ND (US)

(72) Inventor: Nikhil Manubhai Patel, Grand Forks, ND (US)

( * ) Notice: Subject to any disclaimer, the term of this patent is extended or adjusted under 35 U.S.C. 154(b) by 88 days.

(21) Appl. No.: 16/779,775

(22) Filed: Feb. 3, 2020

(65) Prior Publication Data

US 2020/0208069 A1 Jul. 2, 2020

Related U.S. Application Data

(63) Continuation of application No. 15/990,725, filed on May 28, 2018, now Pat. No. 10,550,343, which is a (Continued)

(51) Int. Cl.
*C10J 3/08* (2006.01)
*C10K 1/02* (2006.01)

(Continued)

(52) U.S. Cl.
CPC . *C10J 3/08* (2013.01); *C10J 3/22* (2013.01); *C10J 3/26* (2013.01); *C10J 3/723* (2013.01); *C10K 1/024* (2013.01); *C10K 1/026* (2013.01); *C10J 2300/092* (2013.01); *C10J 2300/093* (2013.01); *C10J 2300/0946* (2013.01); *C10J 2300/0956* (2013.01);

(Continued)

(58) Field of Classification Search
CPC combination set(s) only.
See application file for complete search history.

(56) References Cited

U.S. PATENT DOCUMENTS 1,738,620 A 12/1929 Umpleby
2,538,219 A 1/1951 Welty (Continued)

FOREIGN PATENT DOCUMENTS

DE 10030778 A1 1/2002
EP 0364074 A1 4/1990

(Continued)

*Primary Examiner* — Kaity V Chandler
(74) *Attorney, Agent, or Firm* — O'Connor & Company; Ryan P. O'Connor

(57) ABSTRACT

The present invention discloses a gasifier and/or a gasification process that provides a long, uniform temperature zone in the gasifier, regardless of the particle size, chemical composition, and moisture content of the fuel by sandwiching a reduction zones between two oxidation zones. The gasifier and/or gasification process has a char that is more energy-dense and almost devoid of moisture that affords for an additional (or char) oxidation zone with a temperature that is higher than a first oxidation zone which is closer to an evaporation and devolatilization zone. As such, the additional (or char) oxidation zone contributes to augmenting the reduction zone temperature, thereby providing a favorable dual impact in improving syngas composition and near-complete conversion of the tar.

19 Claims, 12 Drawing Sheets

Related U.S. Application Data continuation of application No. 13/210,441, filed on Aug. 16, 2011, now Pat. No. 10,011,792.

(60) Provisional application No. 61/374,139, filed on Aug. 16, 2010.

(51) Int. Cl.
*C10J 3/72* (2006.01)
*C10J 3/26* (2006.01)
*C10J 3/22* (2006.01)

(52) U.S. Cl.
CPC ..... *C10J 2300/0959* (2013.01); *C10J 2300/0976* (2013.01); *C10J 2300/1246* (2013.01)

(56) References Cited

U.S. PATENT DOCUMENTS

| | | | | | |
|---|---|---|---|---|---|
| 2,600,425 | A | | 6/1952 | Parry | |
| 3,746,521 | A | | 7/1973 | Giddings | |
| 3,920,417 | A | | 11/1975 | Fernandes | |
| 4,032,305 | A | * | 6/1977 | Squires | B01J 8/28 48/73 |
| 4,052,173 | A | * | 10/1977 | Schulz | C10J 3/84 48/202 |
| 4,069,107 | A | | 1/1978 | Koppelman | |
| 4,239,614 | A | | 12/1980 | Hutchings | |
| 4,309,195 | A | | 1/1982 | Rotter | |
| 4,323,446 | A | * | 4/1982 | Chervenak | C10J 3/54 208/410 |
| 4,371,378 | A | | 2/1983 | Brent | |
| 4,400,181 | A | | 8/1983 | Snell et al. | |
| 4,479,808 | A | | 10/1984 | Campbell | |
| 4,530,702 | A | | 7/1985 | Fetters et al. | |
| 4,584,947 | A | | 4/1986 | Chittick | |
| 4,707,163 | A | | 11/1987 | Gudymov | |
| 4,826,627 | A | | 5/1989 | Najjar | |
| 4,857,203 | A | | 8/1989 | Pope et al. | |
| 4,857,229 | A | | 8/1989 | Najjar et al. | |
| 4,859,213 | A | | 8/1989 | Segerstrom | |
| 4,876,031 | A | | 10/1989 | Najjar et al. | |
| 4,909,958 | A | | 3/1990 | Najjar | |
| 5,026,403 | A | | 6/1991 | Michel-Kim | |
| 5,562,744 | A | | 10/1996 | Rasanen | |
| 5,688,296 | A | | 11/1997 | Andrus | |
| 6,083,862 | A | | 7/2000 | Wheelock | |
| 6,112,677 | A | | 9/2000 | Kuntschar et al. | |
| 6,680,137 | B2 | | 1/2004 | Paisley | |
| 6,808,543 | B2 | | 10/2004 | Paisley | |
| 6,960,234 | B2 | | 11/2005 | Hassett | |
| 2002/0069798 | A1 | | 6/2002 | Aguadas | |
| 2002/0095866 | A1 | | 7/2002 | Hassett | |
| 2002/0134019 | A1 | | 9/2002 | Paisley | |
| 2004/0208810 | A1 | | 10/2004 | Simell et al. | |
| 2004/0232046 | A1 | | 11/2004 | Tanaka | |
| 2006/0265954 | A1 | | 11/2006 | Dogru et al. | |
| 2007/0012229 | A1 | | 1/2007 | Rehmat | |
| 2008/0073445 | A1 | | 3/2008 | Yu | |
| 2008/0134581 | A1 | | 6/2008 | Van Dyk et al. | |
| 2008/0202028 | A1 | | 8/2008 | Tsangaris et al. | |
| 2009/0000194 | A1 | | 1/2009 | Fan et al. | |
| 2009/0064578 | A1 | * | 3/2009 | Theegala | C10J 3/80 48/76 |
| 2009/0077891 | A1 | | 3/2009 | Duca et al. | |
| 2009/0158658 | A1 | | 6/2009 | Stadler | |
| 2009/0217574 | A1 | | 9/2009 | Coleman | |
| 2010/0018115 | A1 | | 1/2010 | Wallace | |
| 2010/0024300 | A1 | | 2/2010 | Chornet et al. | |
| 2010/0037519 | A1 | | 2/2010 | Patil | |
| 2010/0107493 | A1 | | 5/2010 | Weaver | |
| 2010/0178217 | A1 | | 7/2010 | Alyaser | |
| 2011/0318234 | A1 | * | 12/2011 | Dinu | F02C 3/28 422/139 |

FOREIGN PATENT DOCUMENTS

| | | | | | |
|---|---|---|---|---|---|
| EP | 0386352 | B1 | | 9/1990 | |
| EP | 1167492 | A2 | | 1/2002 | |
| EP | 1312662 | A2 | | 5/2003 | |
| GB | 302607 | | | 12/1929 | |
| GB | 01536654 | A | | 12/1978 | |
| GB | 02144766 | A | | 3/1985 | |
| GB | 2259521 | A | | 3/1993 | |
| GB | 02290487 | A | | 1/1996 | |
| GB | 2466260 | | | 6/2010 | |
| WO | 81001713 | A1 | | 6/1981 | |
| WO | 890002909 | A1 | | 4/1989 | |
| WO | 93022540 | A1 | | 11/1993 | |
| WO | 00006672 | A1 | | 2/2000 | |
| WO | 00057105 | A1 | | 9/2000 | |
| WO | 00069994 | A1 | | 11/2000 | |
| WO | 00069995 | A1 | | 11/2000 | |
| WO | 01051591 | A1 | | 1/2001 | |
| WO | 02046331 | A1 | | 6/2002 | |
| WO | 02050214 | A2 | | 6/2002 | |
| WO | 05083041 | A1 | | 9/2005 | |
| WO | WO-2006045179 | | * | 5/2006 | F23J 1/06 |
| WO | WO-2006045179 | A1 | * | 5/2006 | F23J 1/06 |
| WO | 06082543 | A1 | | 8/2006 | |
| WO | 07082089 | A2 | | 7/2007 | |
| WO | 08009433 | A2 | | 1/2008 | |
| WO | 08033812 | A2 | | 3/2008 | |
| WO | WO-2009093107 | | * | 7/2009 | C10J 3/66 |
| WO | WO-2009093107 | A1 | * | 7/2009 | C10J 3/66 |
| WO | 10022741 | | | 3/2010 | |

* cited by examiner

SANDWICH GASIFICATION PROCESS FOR HIGH-EFFICIENCY CONVERSION OF CARBONACEOUS FUELS TO CLEAN SYNGAS WITH ZERO RESIDUAL CARBON DISCHARGE

RELATED APPLICATION

The present application is a continuation of U.S. Pat. No. 10,550,343, issued on Feb. 4, 2020, which is a continuation of U.S. Pat. No. 10,011,792, issued on Jul. 3, 2018, which claims priority to U.S. Provisional Patent App. No. 61/374,139, filed on Aug. 16, 2010, each of which are incorporated by reference herein in their entireties.

STATEMENT REGARDING FEDERALLY SPONSORED RESEARCH OR DEVELOPMENT

This invention was made with government support from the U.S. Department of Energy under Cooperative Agreement No. DE-FC26-05NT42465 entitled "National Center for Hydrogen Technology" and the U.S. Army Construction Engineering Research Laboratory under Cooperative Agreement No. W9132T-08-2-0014 entitled "Production of JP-8-Based Hydrogen and Advanced Tactical Fuels for the U.S. Military." The government has certain rights in the invention.

FIELD OF THE INVENTION

The present invention is related to a gasification process, and in particular, to a gasification process having at least one endothermic reduction zone sandwiched between at least two high-temperature oxidation zones.

BACKGROUND OF THE INVENTION

The production of clean syngas and complete fuel conversion are the primary requirements for successful gasification of carbonaceous fuels for commercial applications such as production of heat, electricity, gaseous as well as liquid fuels, and chemicals. These requirements are critical to achieving desired process economics and favorable environmental impact from fuel conversion at scales ranging from small distributed- to large-scale gasification-based processes.

Among the commonly known gasifier types defined based on bed configurations (fixed bed, fluidized bed, and entrained bed) and their variants, the downdraft fixed-bed gasifier is known to produce the lowest tar in hot syngas attributed primarily to the bed configuration in which the evaporation and devolatilized or pyrolyzed products are allowed to pass through a high-temperature oxidation zone such that long-chain hydrocarbons are reduced to their short-chain constituents and these gaseous combustion and reduced-pyrolysis products react with unconverted carbon or char in the reduction zone to produce clean syngas. FIG. 1 illustrates general schematics of two variations of the downdraft gasifiers, classically known as Imbert and stratified downdraft gasifiers. The figure depicts the three primary gasification zones: evaporation and devolatilization Zone 1, oxidation Zone 2, and reduction Zone 3. The oxidizer (air) required for maintaining the high-temperature oxidation zone (Zone 2) is injected such that the location of this zone is commonly fixed.

The conversions occurring in Zone 1 are primarily endothermic, and the volatile yields are dependent on the heating rate, which is dependent on fuel particle size and temperature. The reduction reactions occurring in Zone 3 are predominantly endothermic. These reactions are a strong function of temperature and determine fuel conversion rate, thus defining fuel throughput, syngas production rate, and syngas composition.

The heat required to sustain the endothermic reactions in the reduction zone is transferred from the single oxidation zone. Thus production of clean syngas and the extent of carbon conversion heavily depend on the temperature and heat transfer from the oxidation zone to the reduction zone. As shown in FIG. 1, the temperature profile in the reduction zone sharply decreases with the increase in distance from the oxidation zone such that the reduction reaction almost freezes a few particle diameters downstream from the oxidation-reduction zone interface. As a result, this zone is termed as the dead char zone, where further conversion is completely frozen. The unconverted char is required to be removed from this zone in order to maintain continuous fuel conversion. The energy content of the fuel is thus lost in the removed char, resulting in reduced gasifier efficiency and the added disadvantage of the need for its disposal.

The critical factors of size, location, and temperature of the oxidation zone severely restrict the range of carbonaceous fuel that can be utilized in the same gasifier, which is typically designed to convert fuels with a narrow range of physicochemical characteristics, particularly particle size, chemical composition, and moisture content (e.g., typical fuel specifications for commercial biomass gasifier includes chipped wood containing less than 15% moisture and less than 5% fines). Any variation in these fuel characteristics is known to have adverse impacts on gasifier performance, and such fuels are, therefore, either preprocessed (such as moisture and fines reduction using dryer) and/or are restricted from conversion under applicable gasification technology warranty agreements.

As such, the current state of gasifier design and the inability of heretofor gasifiers to maintain a temperature profile required in gasifier zones because of the dual impact of size and temperature reduction of the critical oxidation zone, caused when fuels containing high moisture, high volatiles, or a large fraction of fine particles or fuels having low reactivity when gasified is an undesirable shortcoming of current gasifier technology, In addition, gasification of such fuels results in partial decomposition of the pyrolysis product causing undesirably high concentrations of tar in the syngas as well as adversely affecting its composition and char conversion rate, a combined effect of inadequate temperature in the kinetically controlled reduction zone. Therefore, a gasification process and/or a gasifier that can provide a long, uniform temperature zone in the gasifier, regardless of the above-referenced variations in fuel composition, would be desirable.

SUMMARY OF THE INVENTION

The present invention discloses a gasifier and/or a gasification process that provides a long, uniform temperature zone in the gasifier, regardless of the particle size, chemical composition, and moisture content of the fuel. As a result, any carbonaceous fuel containing high moisture and/or high volatiles can be used as a potential gasification feedstock while maintaining a desired low tar composition of syngas. The gasifier and/or gasification process also addresses one of the major limitations of maximum allowable throughput in a fixed-bed configuration imposed by the geometric restriction of penetration of the oxidizer in the reacting bed for maintaining uniform temperature and fuel conversion profiles.

The gasifier and/or gasification process sandwiches one or multiple reduction zones between two or more oxidation zones, and affords flow of product gases through these zones such that precise control over temperature and fuel conversion profiles can be achieved.

DETAILED DESCRIPTION OF THE PRESENT INVENTION

Nomenclature

Figure 1:
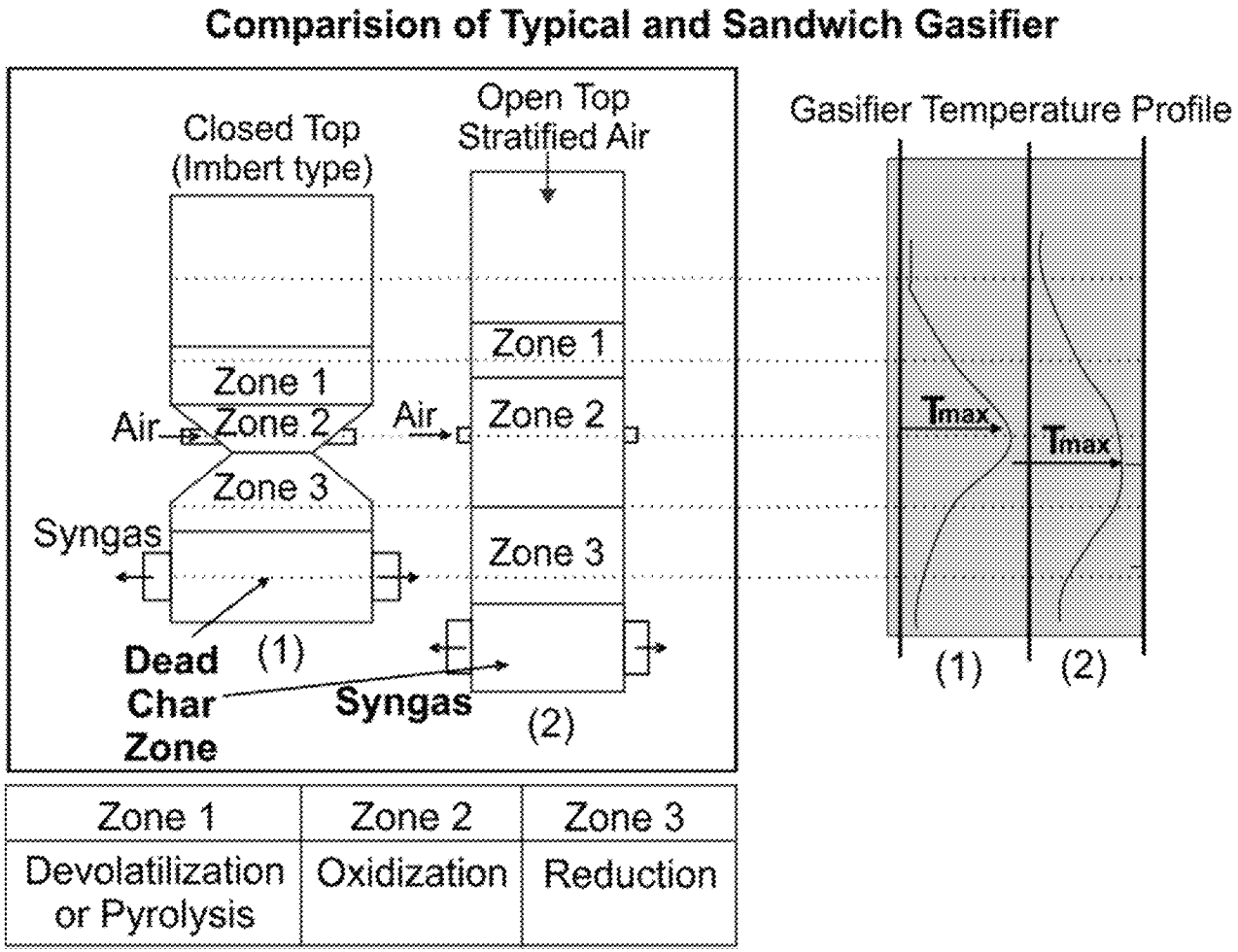
FIG. 1 is a comparison of prior art fixed-bed downdraft gasifiers: 1) Imbert; and 2) stratified based on the location of primary gasification zones, fuel and oxidizer injection, syngas extraction zone and bed temperature profiles.

As used herein, conventional carbonaceous fuels are those in which the combustion process is known or carried out for energy recovery. Such fuels are generally classified as biomass or coal.

As used herein, nonconventional carbonaceous fuels are typically industrial or automotive wastes having a complex composition such that their conversion requires a nontypical method of feeding or injection, residue extraction, devolatilization process control, and devolatilized product distribution for effective gasification or destruction of toxic organic compounds by maintaining aggressive gasification conditions achieved by supplemental fuel or catalysts. Such fuels include whole automotive tires consisting of steel wires and carbon black, structural plastics material clad with metal or inert material, contaminated waste material requiring aggressive gasification conditions, printed circuit boards, waste fuel, heavy-organic-residue sludges, and highly viscous industrial effluents from the food and chemical industries.

As used herein, primary fuel is the largest fraction of the conventional and nonconventional fuels injected upstream of the oxidation zone (OX-1) in the zone defined as ED-1, ED-2, etc. (discussed in greater detail below with reference to FIGS. 8-11), with the help of the gasifier main feed systems.

As used herein, secondary fuel is the small or minor fuel fraction formed within the gasification process (e.g., combustible fuel formed in the syngas cleanup system) and cogasified for the purpose of improving syngas composition. These fuels are injected/coinjected with primary fuels and/or injected separately in the primary gasification zones (evaporation and devolatilization, oxidation, and reduction zones) with or without the help of an oxidizer or carrier gas and with the help of a dedicated fuel injection system.

As used herein, auxiliary fuel is defined as fuel other than the primary and secondary fuels and includes syngas and injectable fuels that can support stable combustion.

As used herein, oxidizer is defined as the substance that reacts with the primary and secondary fuels in at least two oxidation zones. One or more types of oxidizer can be simultaneously used in pure or mixed forms. Pure oxidizers include air, oxygen, steam, peroxides, ammonium perchlorate, etc.

As used herein, mixed-reaction (MR) mode is a process in which at least two types of bed are formed in a single gasifier in order to facilitate fuel conversion, e.g., fuel with a large fraction of fines and friable char (or low-crushing-strength material) is injected into a packed-bed configuration; however, after passing through the ED-1 and OX-1 zones, the friable material is subjected to enough crushing force such that its particle size is reduced or can be easily broken by mechanical crushing. It is possible to inject such fine fuel in the MR zone (like oxidation-2 and RD-1 in FIG. 3) such that the falling material gets entrained in the gas phase and achieves further conversion and/or falls on the grate (or distributer plate) and is converted under the fluidized-bed operating mode.

The invention aims to convert carbonaceous fuel or a mixture of carbonaceous and noncarbonaceous material into a combustible mixture of gases referred to as syngas. Since the chemical conversion occurs as a result of heat, the process is commonly known as the thermochemical conversion process. Thus the aim of the process is to convert (or recover) the chemical energy of the original material into the chemical energy of syngas. The required process heat is either fully or partially produced by utilizing primarily the chemical energy of the original fuel. The invention allows the injection of heat from an auxiliary source either through direct heat transfer (heat carrier fluid injection, e.g., steam, hot air, etc.) or indirectly into the reaction zones. The primary embodiments of the invention are to maximize the gasification efficiency and flexibility of the conversion process.

Figure 2:
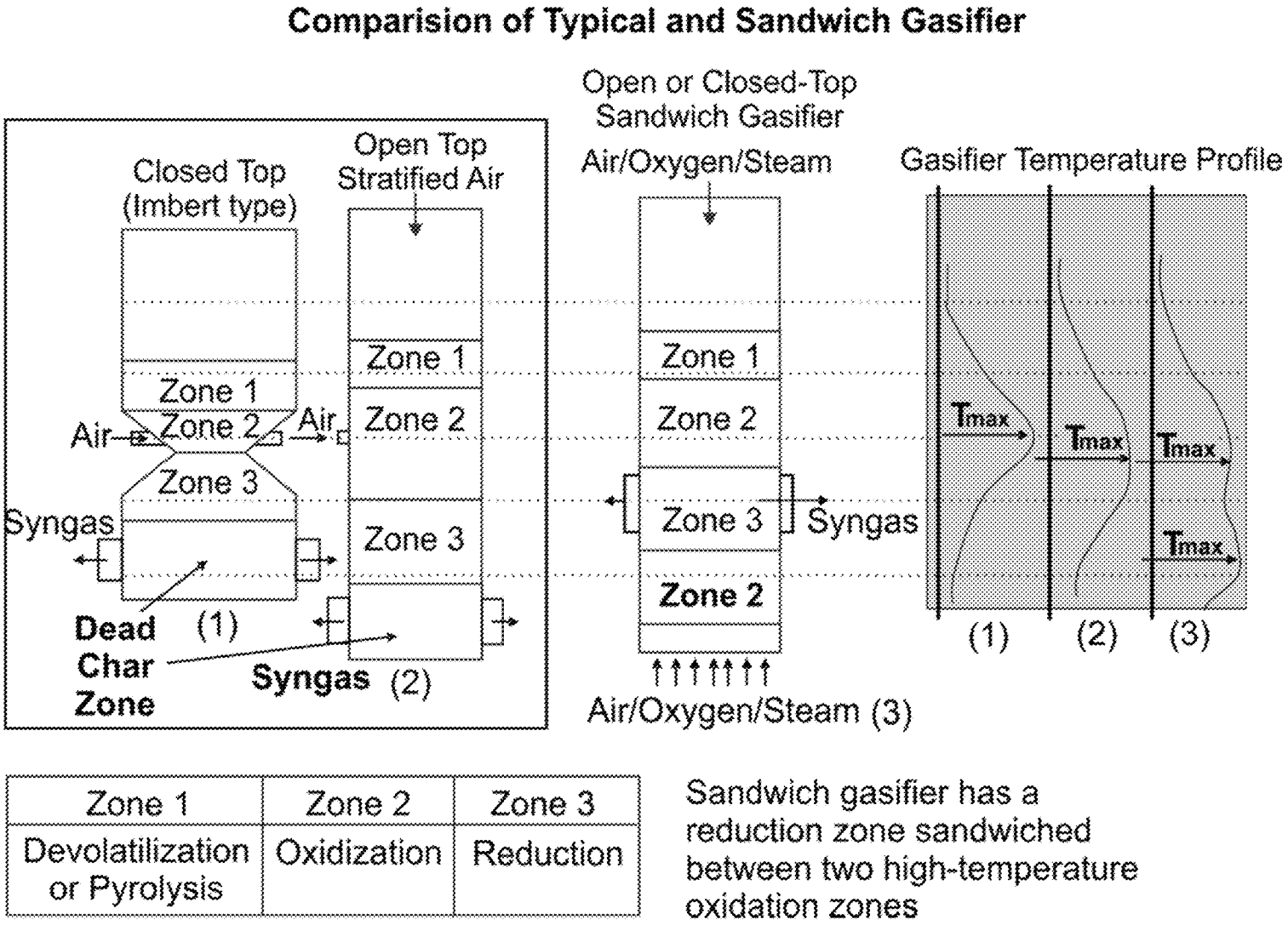
FIG. 2 is a comparison of the two prior art fixed-bed downdraft gasifiers shown in FIG. 1 and a gasifier according to an embodiment of the present invention.

FIG. 2 shows a schematic of the invention gasifier in which reduction Zone 3 located directly next to and is sandwiched between two oxidation zones such that the temperature of the reduction zone is augmented by direct heat transfer from the relatively higher-temperature secondary oxidation zone fueled by char. The comparative temperature profile of the prior art gasifiers and single-reduction zone sandwich gasifier is shown in FIG. 1, and FIG. 2 for comparison. Since the char is more energy-dense and almost devoid of moisture, the additional (or char) oxidation zone temperature is relatively higher than the first oxidation zone, which is closer to the evaporation and devolatilization zone. As a result, the dead char zone in the prior art gasifier contributes to augmenting the reduction zone temperature, causing a favorable dual impact in improving syngas composition and near-complete conversion of the tar, thus producing clean syngas.

The choice of oxidizer/gasification medium in one or more of the gasifier zones located near the exit plane of the gasifier can provide selective heating of the inorganic residue to high temperatures (1450°-1600° C.) at which ash vitrification can occur. The sandwich configuration can favorably utilize char (supplemented by syngas as fuel if necessary) in a simple self-sustaining thermal process without requiring high-grade electricity typically used in thermodynamically unfavorably plasma- or arc-based heating processes, a unique feature for attaining high conversion efficiency.

One of the major issues faced in conventional gasification processes is the difficulty of attaining complete carbon conversion of low-reactivity fuels. The char in such a process is typically extracted from the gasifier and either disposed of or oxidized in a separate furnace system. A similar arrangement for carbon conversion is also provided in the case of a solid fuel (biomass, coal, and black liquor) fluidized-bed steam reformer for the production of hydrogen-rich syngas. Because of the predominantly occurring water-gas shift reaction, the concentration of $CO_2$ in syngas is high, along with very high concentrations of unconverted tar. The sandwich gasification process overcomes the difficulties found in prior art gasification processes and attains clean, hydrogen-rich, low-$CO_2$ syngas by effectively utilizing carbon/char in situ to provide temperatures favorable for Boudouard reactions. The unreactive char is converted in the mixed-mode gasification zone of the sandwich configuration involving the entrained- and/or fluidized-bed zone formed by the hydrodynamics of the fine char and gasification medium or oxidizer.

The basis of the invention is explained with the help of results from equilibrium calculations conducted to determine the effect of parametric variations on fuel conversion using model fuels such as biomass (pine wood) of varying moisture content (0%-60%), biomass char (carbonaceous residue obtained from the gasifier), and an oxidizer such as air and 10% enriched-oxygen air.

FIGS. 3-6 show plots depicting the effect of varying equivalence ratio (ER, defined as ratio of actual oxidizer-to-fuel [o/f] ratio and stoichiometric o/f ratio) on adiabatic flame temperature; mass fractions of unconverted carbon; mole fractions of $CO+H_2$, $CO_2$, $H_2O$, $N_2$; and higher heating value of the syngas at equilibrium reaction conditions. An ER=0 indicates zero oxidizer injection rate, and an ER=1 is achieved at a stoichiometric injection rate. An ER ranging between 0 and 0.7 indicates a gasification range representing low ER, intermediate ER, and high ER gasification ranges as indicated in the figures. An ER ranging between 0.7 and 1.2 (as shown) is marked as a combustion range, with a chance of extending the upper range to as high as sustained combustion of the fuel is possible. The inclusion of a gasification and combustion ER range is aimed at facilitating an explanation of the distinctions between the two and their interactions in the sandwich gasification mode, a primary embodiment of the current invention.

ERs ranging from 0.7 to 1.0 and greater than 1 are identified as fuel-rich and fuel-lean combustion zones, respectively. The gasification range ER (0-0.7) is typically intended for production of syngas containing a major fraction of the chemical energy of the original fuel. The chemical energy is completely converted to sensible heat at stoichiometric (or ER=1), or fuel-lean, combustion. Fuel-rich combustion is primarily intended to achieve stable combustion producing manageable low-temperature product gases compared to the highest possible temperature achieved near stoichiometric conditions. A small fraction of the unconverted chemical energy in the gas is released in the secondary-stage oxidation process. As required in most combustion applications, the fuel-lean condition is aimed at attaining low-temperature product gas, achieved as a result of the dilution effect of the oxidizer.

The plot in FIG. 3*a* shows the ER vs. adiabatic flame temperature (AFT) variation in the case of fuels containing moisture ranging from 0% to 60% by fuel weight. The plot also depicts the favorable temperature range at which endothermic gasification reactions responsible for the conversion of fuel to syngas conversion occur. As can be seen, the AFT decreases with a decrease in ER and an increase in biomass moisture. It is known that an operating temperature of 1000° C. or greater is required for driving the kinetically dependent gasification reactions, particularly the Boudouard and shift reactions. Temperatures lower than this will cause an increase in fuel conversion time and/or achieve incomplete fuel conversion, A well-designed self-sustained or autothermal gasification process is operated within the intermediate ER range primarily to attain the required temperature for complete fuel conversion to syngas. It is understandable that complete fuel conversion at the lowest possible ER produces syngas with the highest chemical energy. This operating condition also allows production of syngas with the lowest concentrations of diluents, primarily $N_2$ and $CO_2$ (as shown in FIG. 3*b*). It is, however, difficult to achieve operation under this condition, particularly if the AFT is below the prescribed temperature limits set because of the kinetics of the gasification reactions. This fact, therefore, limits both fuel moisture as well as operating ER, particularly for achieving self-sustained gasification conditions.

The plots in FIG. 3*c* depict mass fractions of unconverted carbon at a low ER. This fraction of unconverted carbon (or char residue in a practical gasifier), attributed to low AFT, constitutes more than half of the unconverted chemical energy in the fuel, As a result, the concentration of CO and $H_2$, the primary carriers of the chemical energy, decreases, as shown in FIG. 3*d*, and the concentration of unconverted $H_2O$ increases, as shown in FIG. 4. Both of these factors result in lowering gasification efficiency.

The gasifiers used in practice are designed primarily to achieve the highest possible conversion of carbon. Since the adiabatic condition is difficult to achieve because of the inevitable heat losses from the gasifier, the operating temperatures are typically lower than the AFT. As a result, the unconverted char fraction is higher, even at intermediate ER operating range. This volatile, depleted residue (or char) is typically removed from the gasifier. Since the reactivity of such char decreases after exposure to atmospheric nitrogen, the value of such char as a fuel is low, and thus it becomes a disposal liability. This further limit the operating regimes of the ER and operable moisture content in the fuel. Fuels with a lower AFT at an intermediate range ER (such as in the case of high-moisture biomass) are operated at a high range ER, although at the cost of syngas chemical energy, thus lowering the concentration of $H_2$ and CO (see FIG. 3*d*).

The embodiment of the sandwich gasification process is to overcome the above-stated limitations by staging the operating ER in multiple sandwiching zones and establishing corresponding equilibrium conditions by creating high-temperature conditions within the single reactor by in situ conversion of the fuel residue or char normally removed from the conventional gasifier. The effectiveness of char and the approach to the sandwiching are discussed as follows.

FIG. 5*a* shows ER vs. AFT variation for model fuel biomass containing 40% moisture obtained with air as the oxidizer, dry char with air and 10% oxygen-enriched air (OEA), and char with 40% moisture and 10% OEA. The simplified configuration of the reacting sandwiching zone for this example can be understood from FIG. 7. The 40% moist biomass fuel injected from the top of the reactor is gasified in the upper zone of the reactor, and the unconverted residue is gasified in the lower zone. The use of 10% OEA reaction with char is to illustrate the flexibility of utilizing a range of oxidizers in the sandwiching zones of the gasifier in order to attain different bed temperatures and syngas compositions. As can be seen in FIG. 5*a*, the AFT of the char-air reaction (Curve C of FIG. 5*a*) in the intermediate ER is 400° to 500° C. higher than that of the fuel with 40% moisture. This is because of the char being more reactive (slightly positive heat of formation and dry in contrast to the wet fuel. The unconverted carbon can thus be utilized for increasing the temperature of the bed of the high-moisture fuel (particularly in the reduction zone) achieved by direct and effective multimode heat transfer in the multiple sandwich zones aided by the passage of hot product gases through these zones. The AFT could be further increased by increasing the oxygen concentration in the oxidizer stream as shown in Curve D of FIG. 5*a*. Such an operating condition can also be utilized in attaining ash vitrification temperature in the high ER gasification mode or, if desired, in selective zones of the gasifier. The addition of moisture to char gasification significantly reduces the AFT in the low ER gasification zone as represented by Curve B in FIG. 5*a*. However, in contrast to the high-moisture fuel, the AFT is in the range that can support gasification reactions and produce hydrogen-rich gas and/or control bed temperature. Thus, the sandwiching of gasification zones of two different characteristic materials formed from the same feedstock can be achieved in the same gasifier. This ability to synergize the conversion process in the sandwich gasification mode is one of the primary embodiments of the invention.

Figure 9:
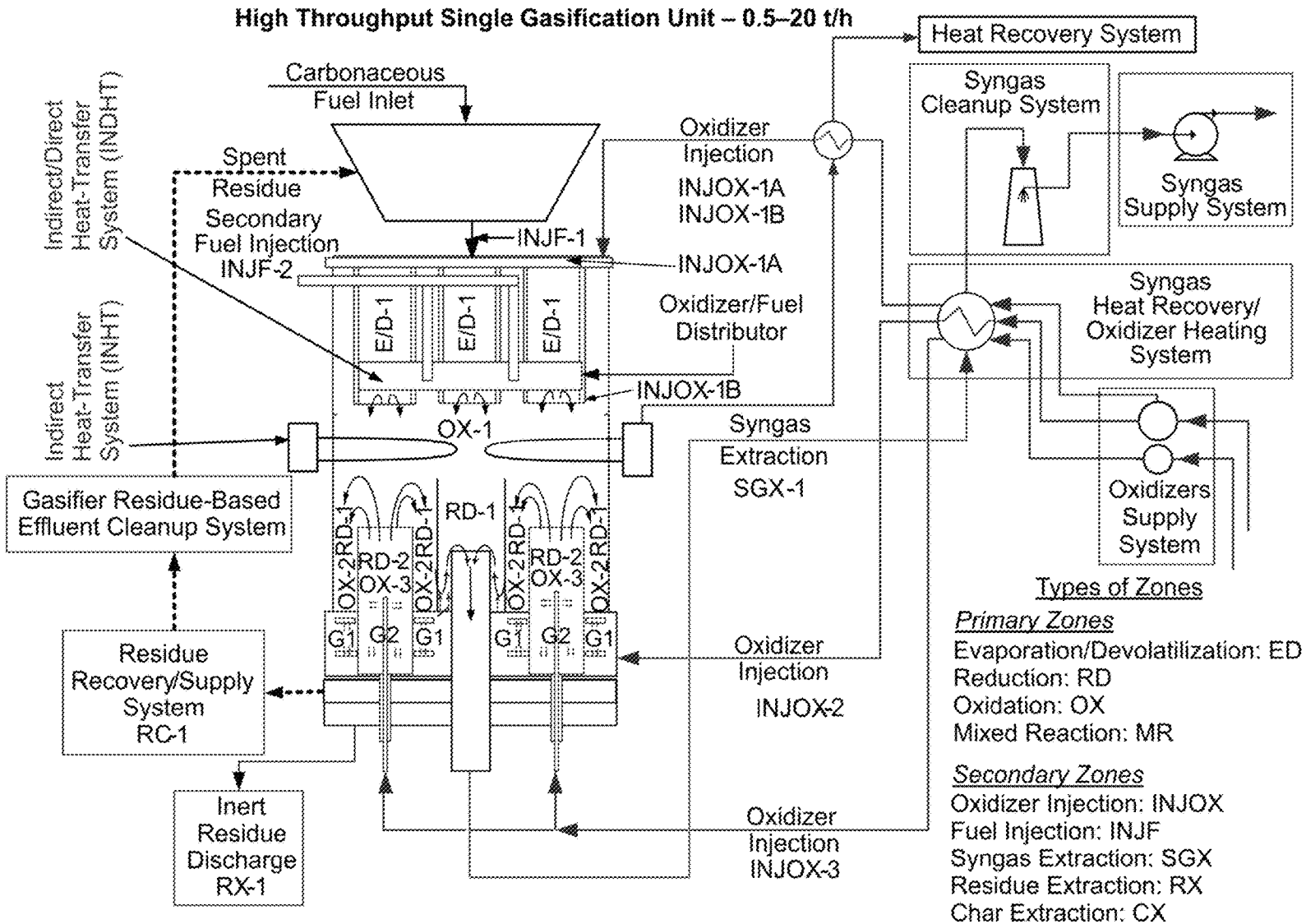
FIG. 9 is a schematic illustration of a single- and mixed-mode sandwich gasification process depicting two reduction and three oxidation zone systems for intermediate and high ranges of fuel throughput (0.5-20 t/h)

In order to achieve different ER and corresponding equilibrium conditions in the gasifier the oxidizer distribution could be achieved such that a number of sandwiching zones are arranged in series and/or parallel in the reactor, as shown in FIG. 9. The direct and indirect heat transfer occurring in the bed as a result of a large temperature gradient (e.g., 1200° C. on the char side and 700° C. AFT on the original fuel side) can attain a bed temperature higher than the AFT for injected high-moisture fuel, as shown in FIG. 5*a*. As a result, both the gas composition and fuel conversion achieved are greater, even when the reaction occurs at a low ER. Such operation improves chemical energy recovery in the syngas and thus gasification efficiency.

Figure 6:
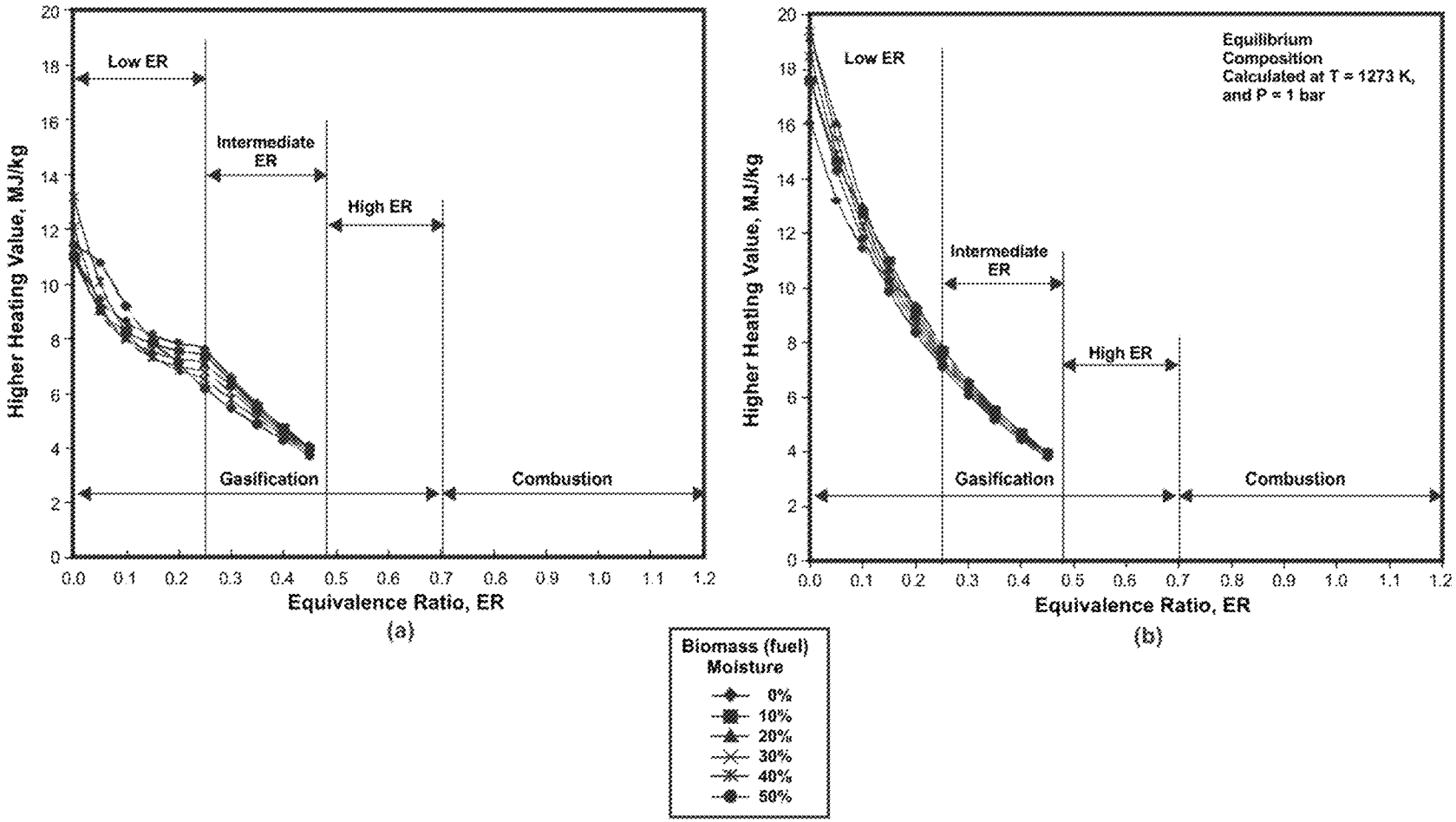
FIG. 6 is a graphical representation depicting HHV vs. ER for model carbonaceous fuel biomass containing moisture ranging from 0% to 50% at: a) constant enthalpy and pressure conditions; and b) constant temperature and pressure conditions.

The ability to transfer heat in the reacting bed (as discussed above) by creating a large temperature gradient within the reacting bed as a result of sandwiching reaction zones is one of the main embodiments of the invention. The example of attaining higher chemical energy by virtue of sandwiching two gasification zones, causing an effective increase in reaction zone temperature, is shown in FIGS. 6*a* and 6*b*, which depicts the variation of the higher heating value (HHV) of the dry syngas with the ER for biomass moisture ranging from 0% to 50%. Heating value is calculated from the syngas composition on a dry basis in order to understand the effect of fuel moisture and ER on chemical energy recovered in the syngas. Since the unconverted moisture at a low ER is significantly higher, as shown in FIG. 4, removal of this moisture from the syngas shows a higher HHV at a low ER. The HHV in FIG. 5*a* is calculated at adiabatic conditions, and FIG. 6*b* is calculated at a 1000° C. bed temperature attained by virtue of heat transfer in the sandwich mode. As can be seen in FIG. 6, the maximum HHV of the gas is obtained when the gasifier operating regime in the sandwich mode is in the low and intermediate ER regime.

FIG. 5*b* depicts the combined $H_2$+CO concentration vs. ER for four different fuel-oxidizer cases, as discussed earlier. Curve A (40% moisture biomass-air reaction) attains the lowest $H_2$+CO concentration in an intermediate or high ER regime in contrast to all examples with char as the fuel. The 40% moisture char-air and the same char with 10% OEA, represented by Curves C and E, show a combined concentration of greater than 50%. This shows that the char reaction at an intermediate ER can improve the overall syngas composition as well as provide high-temperature operating conditions for achieving fast gasification reactions in the sandwich mode.

FIG. 5*c* shows ER vs. $CO_2$ concentration for four different fuel-oxidizer cases. In the intermediate ER zone, the $CO_2$ concentration in the case of the char-air reaction and the char-10% OEA is less than 2% as a result of fast Boudouard reaction and between 12% and 17% in the case of the 40% biomass-air reaction. Both of these conditions have been experimentally observed. In the sandwich mode, as a result of the combined effect of mixing of gas streams as well as achieving higher bed temperature, the invention results in the reduction of $CO_2$ in the syngas.

The fuel conversion process in the sandwich gasifier invention occurs in three types of primary zones and four types of secondary zones arranged in a characteristic pattern such that it facilitates complete conversion into the desired composition of clean syngas and residue. The primary zones are designated as: (1) evaporation and devolatilization zone (ED); (2) oxidation zone (OX); (3) and reduction zone (RD), whereas the secondary zones are designated as: (1) fuel injection zone (INJF); (2) oxidizer injection zone (INJOX); (3) syngas extraction zone (SGX); and (4) residue extraction zone (RX).

Figure 10:
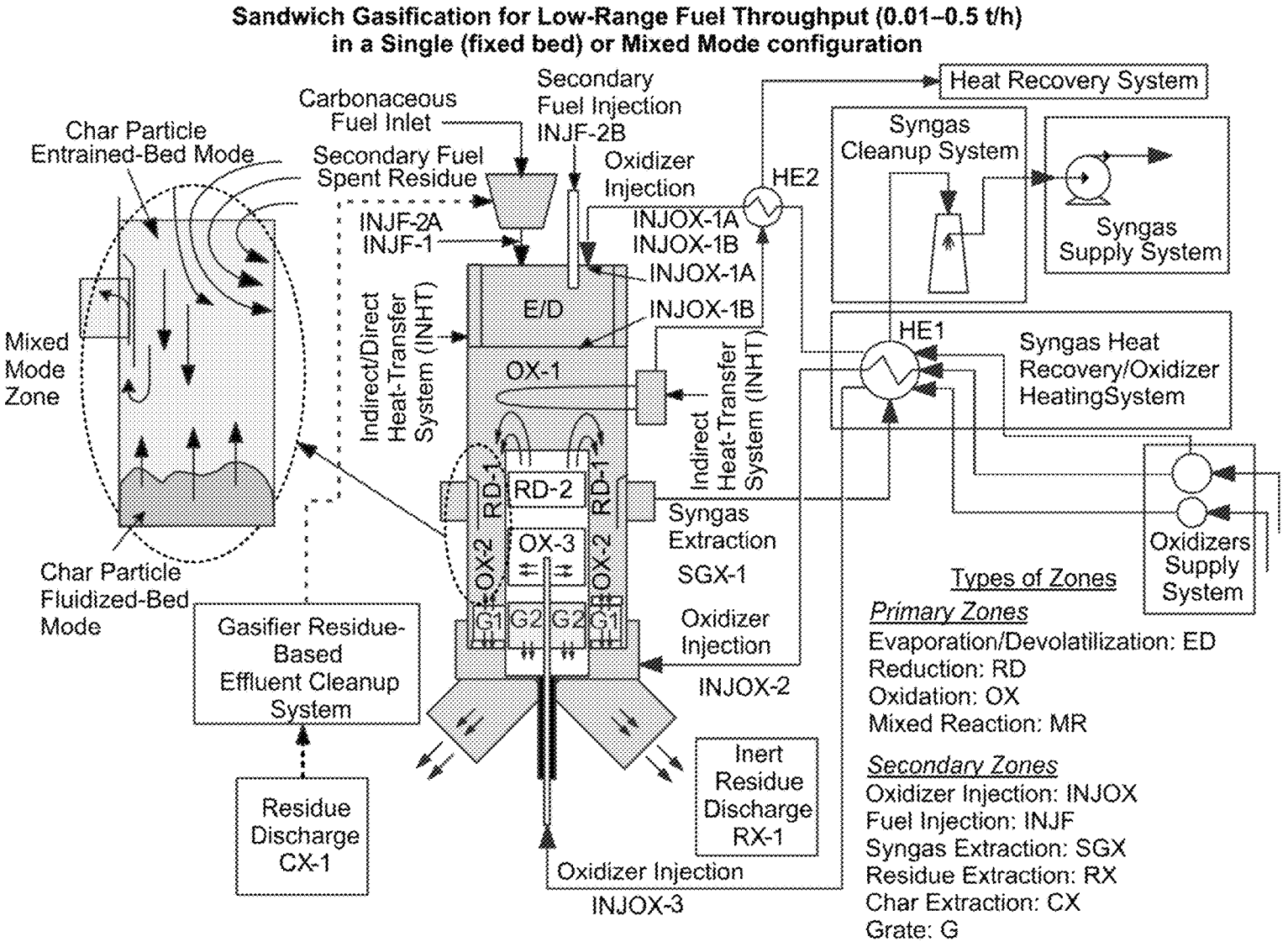
FIG. 10 is a schematic illustration of a single- and mixed-mode sandwich gasification process depicting two reduction and three oxidation zone systems for low-range fuel throughput (0.01-0.5 t/h) consisting of a single oxidizer injection lance at the fuel injection and residue extraction zone.

The role of the primary zones is to thermochemically decompose complex fuel into energy-carrying gaseous molecules, while the role of the secondary zones is to transport the reactant and product in and out of these zones. The reacting bed configuration is either a fixed bed or a combination of fixed, fluidized, and entrained bed, referred to as an MR bed or zone, as shown in FIG. 10.

Gasifier Operating Conditions and Configuration

The gasifier is operated under negative (or subatmospheric), atmospheric, or positive pressure, depending on the fuel and syngas applications. The operating temperature of individual reacting zones depends on the fuel type, extent of inert residue requirements, type of oxidizer, and operating ER, and it is independent of the operating pressure. The fuel and oxidizer injection method are dependent on the operating pressure of the gasifier.

Figure 7:
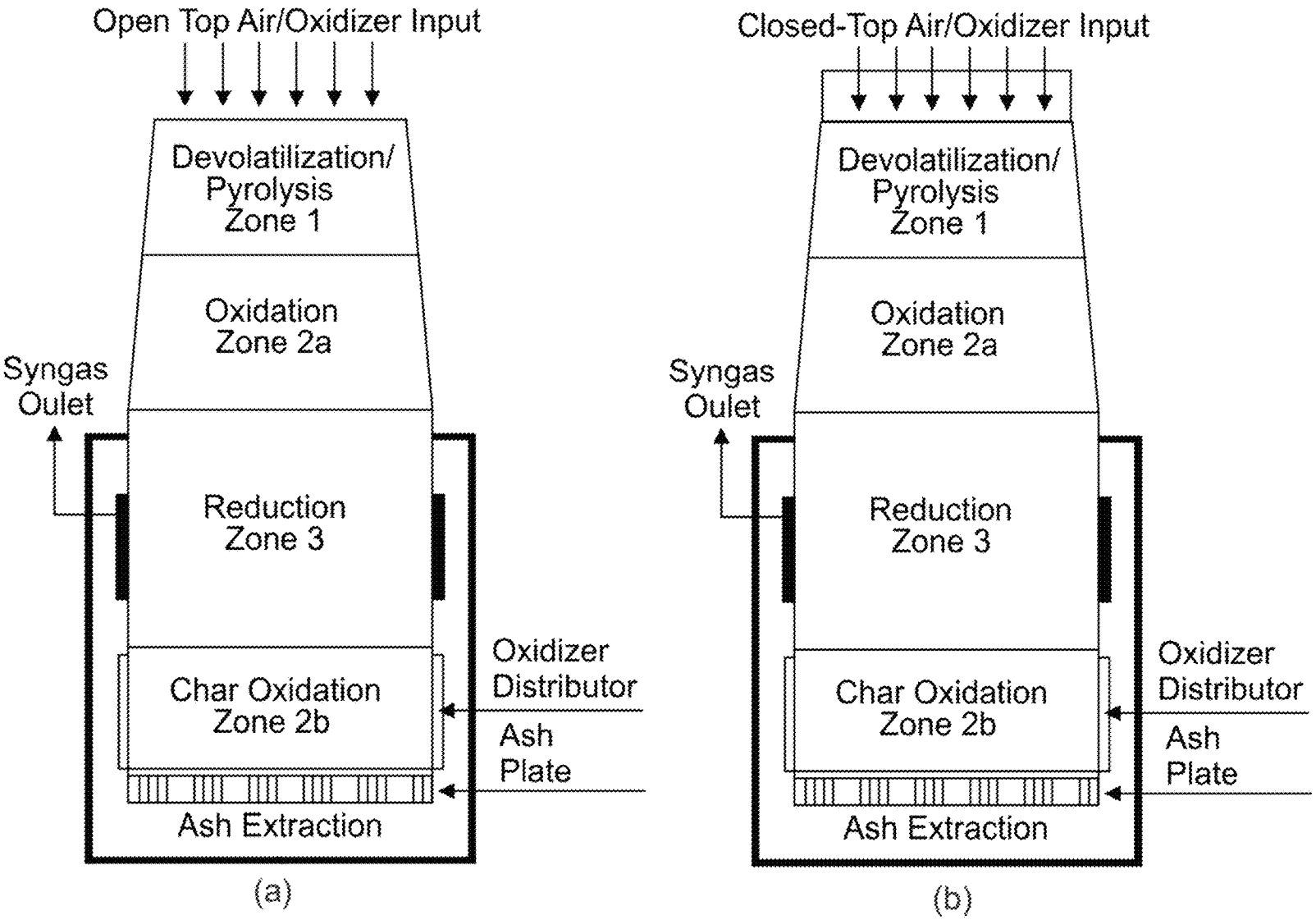
FIG. 7 is a schematic illustration of a sandwich gasification process according to an embodiment of the present invention depicting two configurations: a) open top; and h) closed top defined by gasifier operating pressure and fuel and oxidizer injection methodology with the position of the devolatilization zone, reduction zone sandwiched between two oxidation zones, and location of the syngas exit port shown.

The primary embodiment includes a gasifier of open-port and closed-port configurations as shown in FIGS. 7*a* and 7*b*. In addition, a simplified schematic of the sandwich gasification process is also shown in FIG. 7. The two distinct oxidation zones sandwiching the reduction zone are the primary characteristic of the gasification process. It is appreciated from the figure that the reduction zone is located directly next to and sandwiched between the two distinct oxidation zones. These oxidization zones are characterized based on their locations with respect to the reduction zone and inlet or injection of the fuel. The first oxidation zone (Zone 2*a*, as shown in the figure) is located on the side of the fuel and oxidizer injection port (upstream of the reduction zone), and the second oxidation zone (Zone 2*b*) is located toward the primary ash extraction port. The hot gases from both the oxidization zones are directed toward the reduction zone where the primary outlet of the mixed syngas is located. The gas compositions close to the interface of both the oxidation zones are expected to be different; therefore, the term "mixed syngas" is used. Thus, an arrangement for bleeding a fraction of the partial combustion product from Zone 2*b* is provided such that the desired mixed syngas composition can be achieved.

The two oxidizing or gasifying media injected from two sides of the oxidation zones (Zone 2*a* and 2*b*) in the proposed sandwich gasification process can be distinctly different or the same and can be multicomponent or single component, depending on the syngas composition requirement. For example, the gasifying medium can be air or a mixture of enriched-oxygen air and steam or pure oxygen and steam. In the case where steam is the gasifying medium injected from the Zone 2*a* side, the high-temperature oxidation Zone 2*a* is replaced by an indirectly heated zone satisfying all of its functional requirements (heat for pyrolysis and for the reduction zone), and Zone 2*b* is sustained to achieve complete carbon conversion.

The residual ash is removed at the downstream of Zone 2*b* with the help of a dry or wet ash removal system. The fraction of entrained ash is removed with the help of a cyclone or particulate filter system provided in the path of syngas and removed separately. Depending on the temperature in Zone 2*b*, the dry or molten ash may be extracted downstream of the char oxidation Zone 2*b*, depending on the required amount of inorganics and their composition present in the feedstock being gasified. This is one of the characteristics of the sandwich gasification process in which molten ash can be recovered while achieving the higher-efficiency benefit of the low-temperature gasification process.

The open-port configuration is allowed strictly under negative pressure operating conditions such that primary fuel and oxidizers or only oxidizers are injected from ports open to the atmosphere, and the flow direction of the reactant is facing the gasifier (positive) or as a net suction effect (negative pressure) created by one or many devices such as aerodynamic (blower or suction fan and/or ejector) or hydrodynamic (hydraulics ejector) devices and/or devices like an internal combustion engine creating suction. During normal operating conditions of the gasifier, including start-up and shutdown, negative pressure ensures proper material flow in the gasifier and that products are removed from designated extraction zones. The backflow of the gases is prevented by providing physical resistance in addition to maintaining enough negative pressure within the gasifier. The embodiment includes an open-port gasifier that also allows fuel injection with the help of an enclosed hopper or fuel storage device from which the fuel is continuously or intermittently fed to the gasifier (e.g., by enclosed screw, belt, bucket elevator, pneumatic pressure feed system feed, etc.) while the oxidizer is injected with the help of a mechanical or hydrodynamically driven pump (e.g., compressor, twin fluid ejectors, etc.).

The embodiment of the gasifier includes a closed-port gasifier in which the reactants (oxidizers and fuel streams) are injected in a pressurized (higher-than-atmospheric-pressure) gasifier. The fuel is injected from a conventional lock hopper maintained at pressure equilibrated with the gasifier. The oxidizers are injected at pressures higher than gasifier operating pressure. The gas flow in and out of the gasifier is thus maintained by positive pressure. A suction device may be used in order to maintain higher gasifier throughput at low positive operating pressures. In both configurations, the reactant injection is continuous in order to maintain the location of the gasification zones and steady-state production of syngas.

Gasifier Primary Zones

The arrangement of the primary zones and the characteristic operating features are described in the following section.

The ED zone is typically located downstream of the fuel injection zone. There is at least one ED zone in the sandwich gasifier. The primary processes occurring in this zone are evaporation and devolatilization. Within this zone, the occurrence of these processes is either simultaneous or in sequence, depending on fuel size and characteristics. The overall process is endothermic, and the required heat is supplied by the hot reactant and/or fuel combustion products, conduction, and radiation from the interfacing high-temperature oxidation zone. This zone interfaces with at least one oxidation zone, as shown in FIGS. 7-11.

Figure 8:
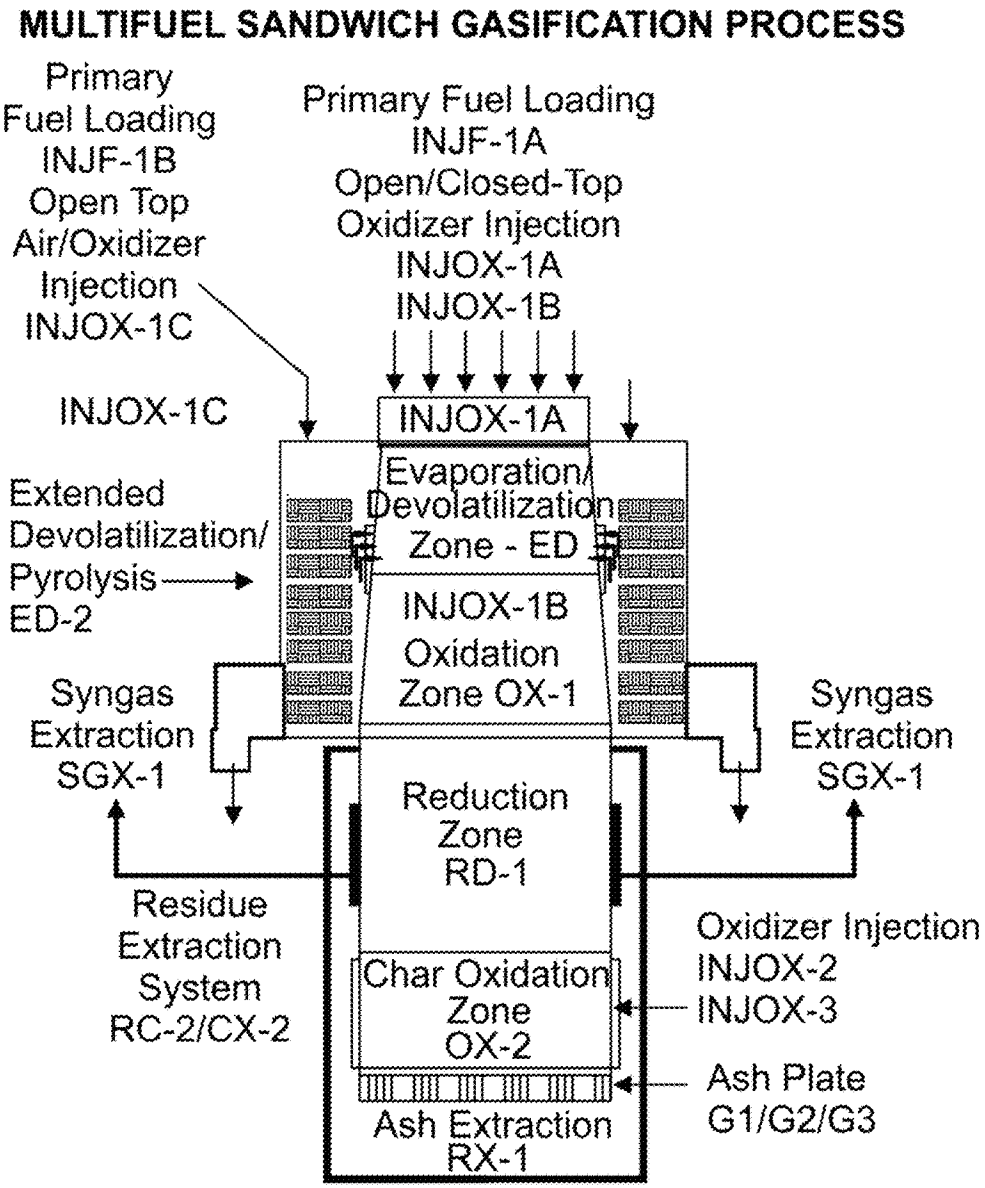
FIG. 8 is a schematic illustration of a sandwich gasification process according to an embodiment of the present invention involving cogasification of two primary fuels of different physicochemical characteristics.
Figure 11:
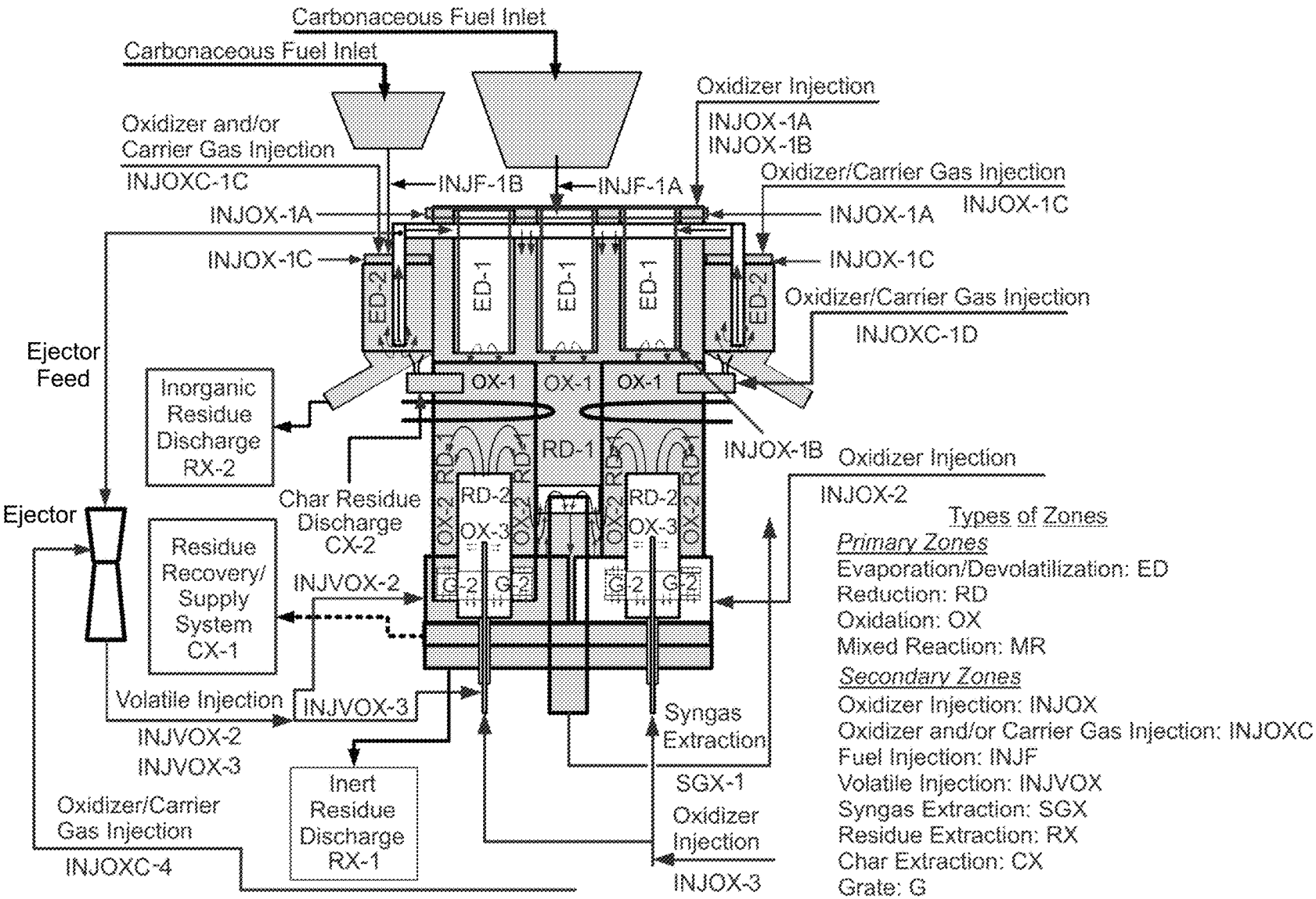
FIG. 11 is a schematic illustration of a sandwich gasification process according to an embodiment of the present invention depicting multiple fuel injection zones, volatile injection zones, and residue injection zones along with an example of several injection and extraction zones in the case of a large-throughput sandwich gasifier.

The case of multiple fuel gasification processes injected separately as primary fuels in the gasifier from different sections in the gasifier but sharing the exothermic heat profile of the hot oxidization zones is shown in FIGS. 8 and 11. Multiple primary ED zones are referred to as ED-2, ED-3, ED-4, etc. Such fuels include all nonconventional fuels defined earlier, including automotive whole tires, plastics, high-inorganic-containing toxic fuels requiring mild conditions for inorganic separation, etc. The devolatilized products are transferred to the primary fuel devolatilized zone for further conversion or are injected in various oxidation zones, as shown in FIG. 11 (INJOX-2 and INJOX-3), with the help of an oxidizer or carrier gas for an aerodynamic propulsive device such as an ejector.

The combustible residue is injected in the primary zone (CX-2, FIG. 11) after removal of separable inorganics for recycling of the toxic metals by an immobilization process or for a separate application (RX-2, FIGS. 8 and 11). An example of such conversion is whole automotive tires used as fuel, in which steel wires are separated from char or carbon black after devolatilization and softening of the tire, and the char is then injected in the primary zone for achieving complete conversion.

The process provides the flexibility of utilizing another primary fuel (ED-1 zone) to improve gasification efficiency and produce clean syngas in the case of fuels lacking in residue (e.g., plastics containing near 100% volatiles, requiring conversion over a catalytic carbon bed). The feature allows utilization of an inert bed or catalyst bed sandwiched between oxidation zones for attaining uniform temperature in the reacting bed consisting of inert solids. As shown in FIG. 7, the necessary volatile distribution is achieved by injection of different fractions of volatiles from the primary zones (ED-1 and/or ED-2) in the sandwiching oxidation zones. This unique approach is aimed at converting high-volatile fuels in the gasifier to clean syngas, which is difficult to achieve in conventional gasifiers in which volatiles remain unconverted as a result of cooling of the gasification zones because of excess volatiles.

The OX zone is characteristically a high-temperature zone where the oxidative reaction between the primary and secondary fuels and/or devolatilized products from these fuels (volatiles and char) and oxidizing gasification medium occurs. There is at least one OX zone that interfaces with at least one ED zone, and there are at least two OX zones interfacing with at least one reduction (RD) zone (described in the following text) characterizing the present invention. The primary purpose of these zones is to maintain an exothermic heat profile necessary to sustain endothermic reactions in the RD and ED zones.

The distinct difference between the OX-1 and other oxidation zones such as OX-2 and OX-3 (shown in FIGS. 9-11) is that the major oxidative processes occur between devolatilized products from ED-1 (and ED-2 in case of multiple primary fuels) in the gas-phase homogeneous reaction, and a small fraction of char is oxidized in the heterogeneous reaction in the OX-1 zone, while in the OX-2 and OX-3 zones (or OX-4 and so on), the char and gaseous desorbed products from the char are primarily oxidized to produce temperatures higher than that in the OX-1 zone. In addition, because of the ability of the OX-2 and OX-3 zones to achieve higher temperatures, these zones can accommodate conversion of devolatilized products from ED-1 and/or ED-2, aerodynamically pumped and distributed into these zones, as shown in FIG. 11.

Figure 3:
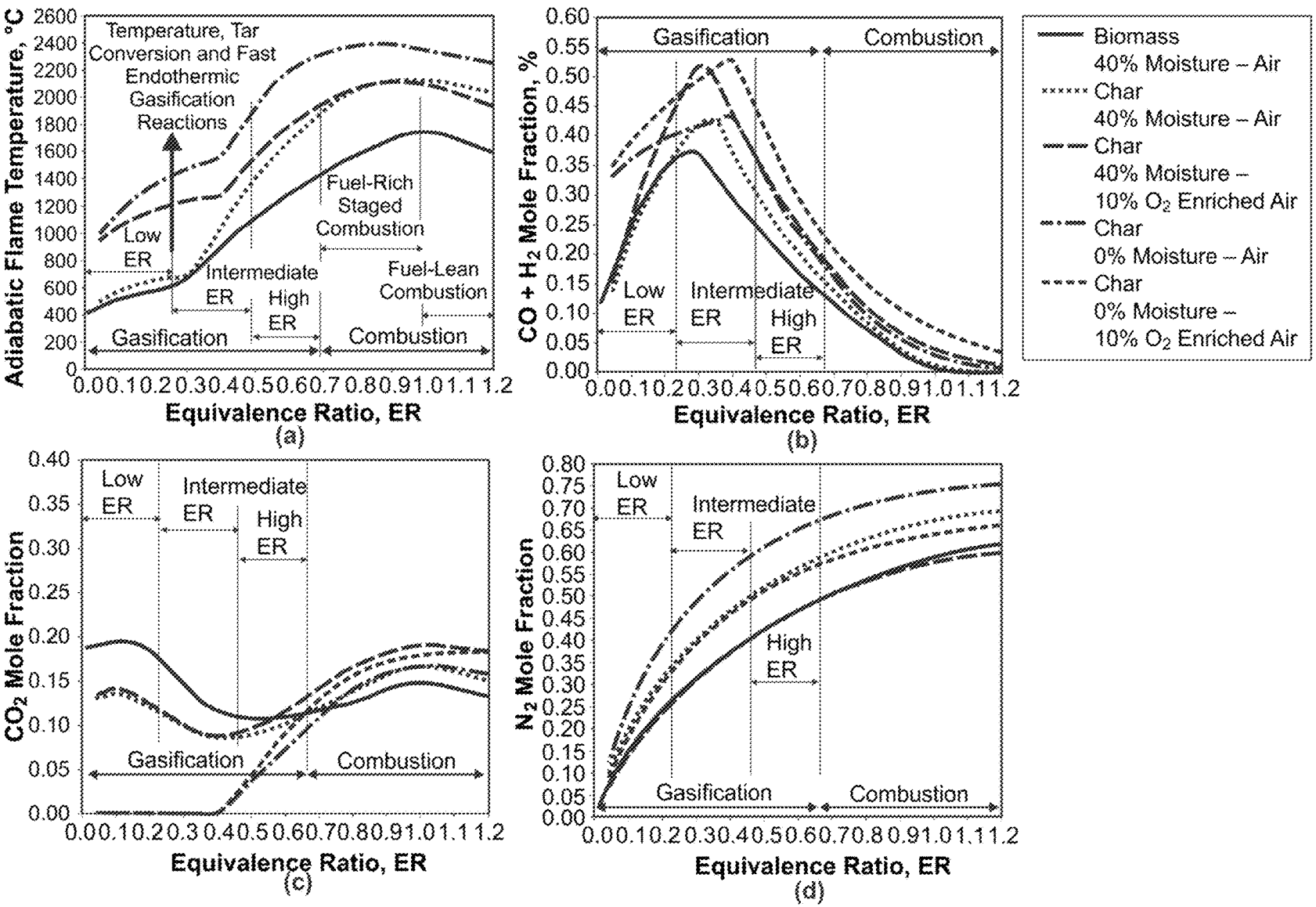
FIG. 3 is a graphical representation of the effect of ER on the variation of: a) AFT; b) mass fraction of unconverted carbon; c) $CO+H_2$ mole fraction; and d) inert gas concentration $CO_2$ mole fraction achieved at equilibrium reaction conditions for carbonaceous fuel-biomass containing 0%-60% moisture fraction and oxidizer-air.
Figure 4:
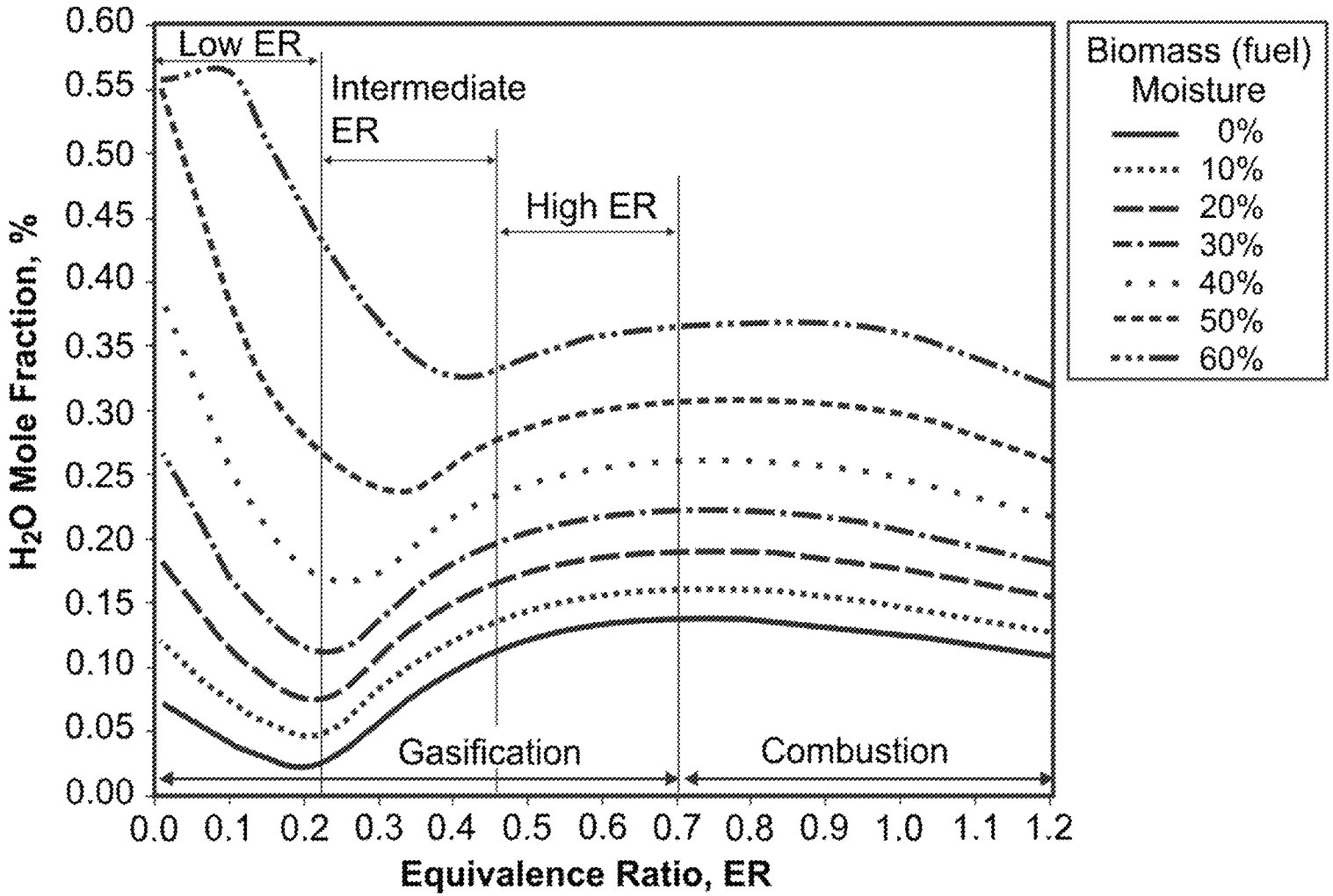
FIG. 4 is a graphical representation of the effect of ER on the variation of $H_2O$ mole fraction achieved at equilibrium for the reaction between the oxidizer (air) and carbonaceous fuel (represented by biomass) containing 0%-60% moisture.
Figure 5:
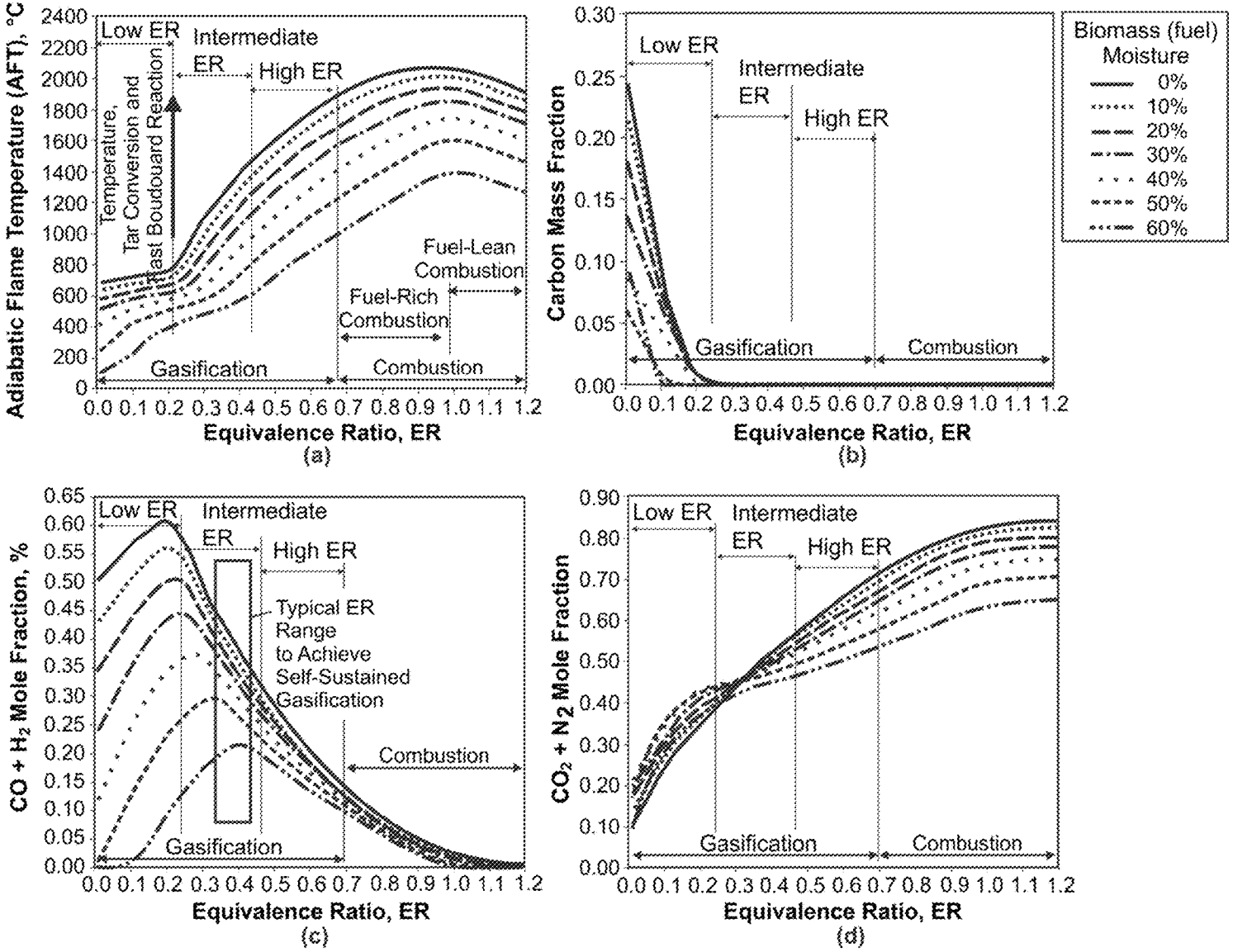
FIG. 5 is a graphical representation of the effect of ER on the variation of: a) AFT; b) $CO+H_2$ mole fraction; c) $CO_2$ mole fraction; and d) $N_2$ mole fraction achieved at equilibrium for reaction between the oxidizer (air and 10% OEA) and carbonaceous fuel (biomass) containing 40% moisture and residue char containing 0% and 40% moisture (by weight)

In the case of low ER operating mode (ER ranging from near zero to 0.25, with low AFTs but high chemical energy; see FIG. 3 and ER-5), the operating temperature of one of the OX zones is increased by way of indirect heat transfer through a hot oxidation medium and/or indirect heat transfer by means of circulating hot combustion products of auxiliary fuel, which could be syngas or any combustible solid and/or liquid and/or gaseous fuel-oxidizer system, as shown in FIG. 9. The unutilized heat, contained in gaseous by-product from the indirect heat-transfer unit, is utilized in preheating the oxidizer in an external heat exchanger such that the sensible heat conversion to chemical energy in the syngas is augmented by its direct injection into the gasifier. The hydrodynamic features of the combustion process in the indirect heat-transfer device will augment heat transfer in the reacting bed. The indirect heater geometry and heat release rate and its location in the combustor are designed such that mild pulsation (40-300 Hz) in the hot product gas within the duct will cause scrapping of the boundary layer in a manner similar to pulse combustion for attaining augmented heat transfer in the reacting bed. The thermal integration in one of the sandwiching zones is aimed at increasing the temperature to higher than the AFT of the local bed operated at a low ER.

Reduction (RD) zone is sandwiched between the oxidation zones, as shown in FIGS. 7-11. In this zone, reduction reactions between the combustion products from sandwiching the oxidizing zones (OX-1 and OX-2) and unconverted carbon occur. The reactant species and their concentrations and the ambient temperature and hydrodynamic conditions at the interface of the oxidation and RD zones in the sandwich are dependent on the processes in the oxidation zone.

Two examples of different fuels are considered to explain this process as follows.

Example 1 is the conversion of coal and biomass at atmospheric conditions with air the gasification medium, with two reduction and three oxidation zones (see FIG. 8 for reference). The partial oxidation of devolatilized species in OX-1 will generate species having hydrocarbon and oxygenated hydrocarbons as precursors, along with a large fraction of unconverted water vapor from the ED-1 zone. While in OX-2, the species are primarily from partial heterogeneous char combustion containing a negligible fraction of hydrocarbon species. The AFT of the char-air reaction in OX-2 is higher than the AFT of the OX-1 side. This example thus shows that the reduction zone at the interface of the two oxidation zones is different.

Example 2, the conversion of plastics (in ED-2) with biomass (in ED-1) as the primary fuel and air as the gasification medium as well as a volatile carrier from ED-2 to ED-1, will achieve conditions similar to Example 1.

Fuel Injection

The gasification of one or multiple fuel streams is achieved in the same gasifier. The stream of the largest weight fraction of the fuels injected is defined as the primary fuel, and the other smaller fuel stream is defined as the secondary fuel stream.

The primary fuel is gravity and/or mechanically and/or aerodynamically (see definition) force-fed from at least one port located on the top of the gasifier in a top-down injection mode (see FIGS. 7-11). Under a low or zero gravity field situation, the fuel feeding is assisted by mechanical and/or aerodynamic forces and the significance of orientation with respect to the Earth's surface is insignificant. The fuel injection orientation under such a situation is defined by the positive direction of the resulting greatest force moving the material toward conversion zones in the gasifier.

The secondary, or minor, fuel is injected by gravity and/or mechanically and/or aerodynamically from the same and/or different port utilized for primary fuel injection. In addition, the secondary fuel can be injected directly into one or more conversion zones in order to augment the conversion of both the primary as well as the secondary fuel streams.

Depending on the gasifier operating pressure, the pressure in the feed section is equilibrated with the fuel injection chamber with the gasification fluid in order to prevent a reverse-flow situation.

The gasifier can convert fuel of complex shapes and/or liquid and gaseous fuel of all rheological properties. In order to utilize off-the-shelf fuel storage and feed systems, large fuel units are broken down to a small size with the help of conventional equipment. The sized fuel is injected as described above and shown in FIGS. 7-11. Fuels posing difficulty or that are cost-ineffective in bringing down their size are handled differently. Large-sized fuels such as automobile whole tires are inserted in the heated annular space or chamber formed around the gasifier, as shown in FIGS. 8 and 11, such that fuel devolatilization occurs in this zone. The devolatilized products are injected in the gasifier for further conversion along with the primary fuel and/or the residual char formed in the annular chamber injected in the gasifier.

Oxidizer Injection

The gasifier invention consists of at least two distinct oxidation zones separated by at least one reduction zone. In the gasifier, there is at least one oxidation zone that interfaces with a devolatilization zone named as "OX-1," as shown in FIGS. 7-11. The oxidizer is injected in stages in OX-1. The first-stage injection occurs upstream of the devolatilization zone ED-1, named as INJOX-1A, and the second-stage injection occurs near the interface of ED-1 and OX-2 for the zone INJOX-1B.

The oxidizer is preheated in an external heat exchanger to a temperature ranging from 100° to 600° C. prior to its injection. The hot oxidizer injected through INJOX-1A helps to uniformly preheat the fuel bed, transporting devolatilized product produced in ED-1 to the oxidation zone and achieving partial premixing of the fuel and oxidizer prior to the OX-1. In the case of large-sized fuel injected as the second primary fuel in zone INJF-2, the devolatilized product from the annular space or chamber formed around the gasifier is injected in the gasifier with the help of an oxidizer or a carrier gas injected from zone INJOX-1C, as shown in FIGS. 8 and 11. The partially premixed fuel-oxidizer or fuel-carrier gas system from the annular section is injected in the gasifier ED-1. The mode of injection and the purpose of injection through INJOX-1A and INJOX-1C are similar.

Oxidizer injection from INJOX-1B is to stabilize the location of the oxidation zone and achieve uniform distribution in the reaction zone. The oxidizer is fed from the primary fuel-feeding zone end of the gasifier and injected at the desired point of transition between ED-1 and OX-1 with the help of multiple submerged (into fuel bed) or embedded lance inserted along the axis of the gasifier, as shown in FIGS. 9 and 11. This unique geometry and application of lance are aimed at compartmentalizing the evaporation and devolatilization zones in order to avoid bridging of the complex-shaped solid fuels and maintain smooth fuel flow.

The lance is made from two pipes or cones forming sealed annular space for the flow of oxidizer into the injection zone INJOX-1B and allowing solid flow through the hollow middle section. The oxidizer flows within the annular space of the lance extended up to the oxidizer injection zones. This arrangement is aimed at providing adequate heat-transfer surface area to uniformly heat the fuel bed in order to restrict the fuel flow cross-sectional area in the case of a high-fuel-throughput gasifier having an outer shell diameter greater than 4 ft. In order to augment heat transfer in the evaporation and devolatilization zone, lean combustion of auxiliary fuel is achieved within the enclosed annular space of the lance. The heated lance surface achieves indirect heat transfer while the oxidizer-rich hot product gases provide direct heat transfer. The functions of lance are summarized as follows:

- Compartmentalize the evaporation and devolatilization zone with the lance outside surface provided to assist smooth fuel flow and avoid fuel bridging in the case of solid fuels.
- Provide hot impingement surfaces for injecting wet fuels.
- Provide adequate heat-transfer surfaces for indirect heating of evaporation and devolatilization zones.
- Uniformly inject oxidizer in the INJOX-1B zone flowing through the annular section.
- Provide vibrating surfaces for actuating fuel flow in the gasifier.
- Provide support surface and source of oxidizer to self-aspirating micropulse combustors (MPCs) operated on auxiliary fuels and used as a fuel igniter and vibration source.

The oxidizer injection in the OX-2 and OX-3 zones (and could be OX-3, OX-4, OX-n) sandwiched with RD-1 and RD-2, respectively, as shown in FIGS. 9-11, are located on the residue extraction zones. The oxidizer is injected through a lance (B) similar to those located in ED-1 and OX-1 (Lance A) except that the oxidizers are injected such that the oxidation and reduction zones are formed on inside as well as outside surfaces. The geometry (area of the cross section) of these lances is such that the gaseous mass flux in the bed achieves the highest possible chemical energy (e.g., high concentration of $H_2$, CO, and $CH_4$) in the syngas and hot syngas formed within the lance reduction zone (RD-2) to augment the RD-1 zone temperature profile by direct heat transfer, thus forming a uniform high-temperature profile required to augment the rate of endothermic reactions. In addition to the use of a lance (B) as the oxidizer injector, high-temperature tube and grates (G) are used to achieve uniform oxidizer distribution in the reacting bed.

FIGS. 9-11 do not show injection of the oxidizer from the edge of the lance (B), which can form an oxidation zone at its exit plane; however, such injection can produce multiple sandwich zones whose number will be equivalent to the number of lances in the reactor bottom section.

In order to achieve the MR mode of operation (see definition of MR in the nomenclature), the oxidizer is injected from the grate or distributor plate such that the desired hydrodynamics in the bed (fluidized bed or entrained bed) are achieved. The expanded view of the MR zone is shown in FIG. 10. The location of MR zones can be on both sides of the lances (B) and/or in the inner space of the lance (B), as desired in any configuration of the invention gasifier.

As an alternative to the lance injection system, a fixed-grate or moving-grate system is used, as shown in FIG. 7. The oxidizer in such a system is injected from the bottom of the grate, and the oxidation zone is formed close to the injection of the ports above the grate. Such a gasifier is an example of a single sandwich zone in which the OX-1 zone lance system described earlier remains the same. The invention thus has a provision for retrofitting old grate furnaces with the sandwich gasification process.

Extraction Zone

The syngas, char, and inert residue are extracted from this zone and are represented by SGX-n, CX-n, and RX-n, respectively, where "n" is the number of the zone which is 1 or greater than 1.

The SGX zone is located in the reduction zone and is one of the primary embodiments of the invention. The extraction is caused under the flow condition created by negative differential pressure created in the direction of the flow under both high- and low-pressure conditions. Tar reduction in the active and hot char zones sandwiched between hot oxidation zones is one of the major benefits of extraction from the reduction zone. There is one or multiple uniformly sized and symmetrically distributed extraction ports located in the reduction zone sandwiched by two distinct oxidation zones. In the case of a gasifier with more than one reduction zone, the syngas is extracted from one or multiple extraction zones distinctly located in the respective zones.

The location and configuration of the extraction ports is such that the major fraction of the syngas reverses the flow direction. Such flow rectification is intended to minimize in situ particulate entrainment in the gasifier.

In the case of a low-throughput gasifier, the SGX port is located on the inside gasifier wall where the reduction zone is located, as shown in FIG. 10.

Char (CX) and inert residue (RX) extraction in the current invention occurs from two distinct gasifier zones such that the desired material is extracted at required rates. This is shown in FIGS. 9-11. The sandwiching of the gasifier zones and ability to inject different oxidizers and fuel types in these zones helps to create favorable conditions for the production of char (carbon and inorganic residue) that can be utilized in integrated syngas and scrubber fluid cleanup systems. The char is extracted intermittently or continuously from the CX zone, introduced in the integrated cleanup zones, and controlled by the mechanical movement of the grate and/or aerodynamic force-actuated movement of the material. The spent char from the cleanup system is injected into the gasifier as secondary fuel, either separately in OX-1 or in zones INJF-1 and/or INJF-2, such that it passes through the evaporation and devolatilization zone prior to the OX-1 zone, and the conversion occurs in normal sandwich gasifier operating mode.

The inert residue from the gasifier is extracted from zone RX such that the combustible fraction in the material (mostly carbon) is near zero. This is achieved because residue passes through the hottest zone created by the oxidation of char in a counterflow arrangement. Under steady-state operation, the fuel injection and inert residue extraction rates are maintained such that inert mass balance across the gasifier is achieved.

The embodiment of the research allows precise control in achieving this balance since the oxidizer type and its injection rate in the counterflow mode is easily achieved. In the special case where char reactivity is low as a result of the physicochemical composition of the fuel or reduces as a result of residence time and/or temperature, high ER oxidation can be achieved in the RX zone such that complete conversion is achieved. The injection of OEA or pure oxygen can attain the required temperature in the oxidation zone closest to the RX zone. Depending on the ash fusion temperature, the extraction process is adopted for extracting solid or molten liquid. The hot gaseous products from such a high ER zone are injected in the reduction zones to take advantage of direct heat transfer necessary to promote kinetics in these zones by increasing the temperature, as described earlier.

The embodiment includes activation of char by staged injection of oxidizers in the zones interfacing with RX zone. The inert residue extraction is replaced by activated char extraction and is referred to as ACRX zone (not shown in the figure). The extraction of char from the CX zone is either combined or maintained separately.

Figure 12:
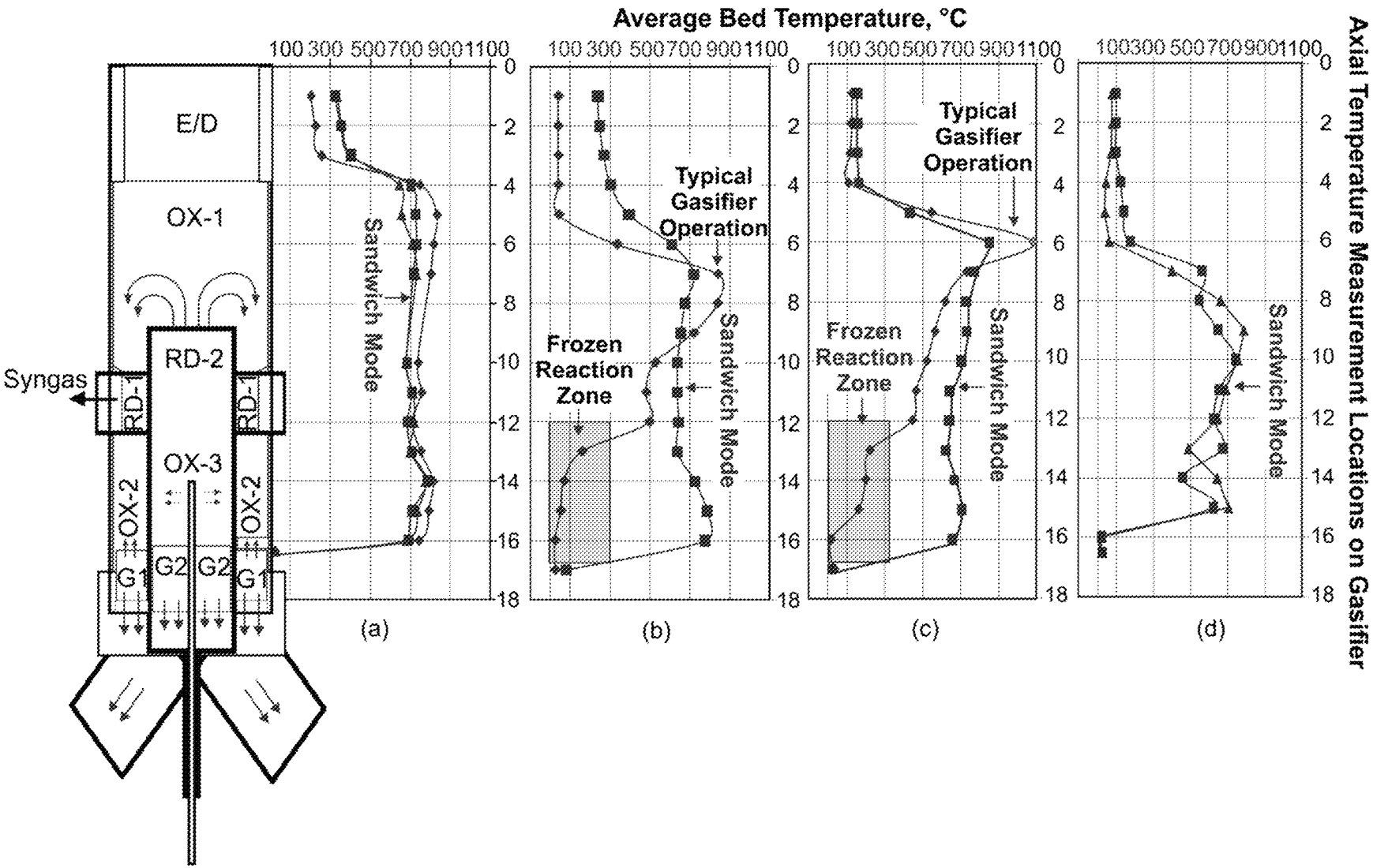
FIG. 12 is an illustration of experimental results depicting time-averaged axial bed temperature profiles obtained during self-sustained gasification in sandwich gasification mode are illustrated for the high-moisture fuels: (a) woody biomass (pine); (b) Powder River Basin (PRB) coal; (c) Illinois #6 coal; and (d) turkey litter.

Referring now to FIG. 12, experimental results depicting time-averaged axial bed temperature profiles obtained during self-sustained gasification in sandwich gasification mode are illustrated for the high-moisture fuels: (a) woody biomass (pine); (b) Powder River Basin (PRB) coal; (c) Illinois #6 coal; and (d) turkey litter. In addition, results from gasifier operation in a nonsandwich or "typical" downdraft gasifier operation mode are illustrated in FIGS. 12(*b*) and (*c*) for comparison. As shown by the comparison, characteristic high-temperature peaks are observed for nonsandwich gasifier operation in contrast to uniform/flat temperature profiles for sandwich gasification gasifier which can provide effective tar cracking and prevent localized clinker formation in the moving bed as is typically observed in conventional downdraft gasifier operations.

It is appreciated that the oxidation zone OX-2 in the sandwich mode can achieve complete carbon conversion unlike typical downdraft gasifiers that require unconverted carbon removal from the low-temperature frozen reaction zone. As such, near-zero carbon and tar conversion in the sandwich gasifier showed high-efficiency gasification of all test fuels. For example, the turkey waste had more than 50% inert matter (43% moisture and 13% inorganics) and yet a self-sustained gasification efficiency was achieved in the sandwich gasifier between 75% and 80% which was much higher than in the typical downdraft gasifier mode. In fact, experiments in typical gasifier mode did not sustain conversion due to the high inert content in the turkey waste.

In view of the teaching presented herein, it is to be understood that numerous modifications and variations of the present invention will be readily apparent to those of skill in the art. The foregoing is illustrative of specific embodiments of the invention but is not meant to be a limitation upon the practice thereof. As such, the application is to be interpreted broadly.

In order to better understand the figures, the following comments are provided. In FIG. 2, it is shown that the sandwich gasifier has a reduction zone sandwiched between two high-temperature oxidation zones. In FIGS. 9 and 10, the following nomenclature is used for each type of zone. For primary zones, evaporation/devolatilization is designated by ED. Reduction is designated by RD. Oxidation is designated by OX. Mixed reaction is designated by MR. For secondary zones, oxidizer injection is designated by INJOX. Fuel injection is designated by INJF. Syngas extraction is designated by SGX. Residue extraction is designated by RX. Char extraction is designated by CX. Grates are designated by G. In FIG. 11, the following nomenclature is used for each type of zone. For primary zones, evaporation/devolatilization is designated by ED. Reduction is designated by RD. Oxidation is designated by OX. Mixed reaction is designated by MR. For secondary zones, oxidizer injection is designated by INJOX. Oxidizer and/or carrier gas injection is designated by INJOXC. Fuel injection is designated by INJF. Volatile injection is designated by INJVOX. Syngas extraction is designated by SGX. Residue extraction is designated by RX. Char extraction is designated by CX. Grates are designated by G. In FIG. 12, the following comments apply. Experimental results depicting time-averaged axial bed temperature profiles obtained during self-sustained gasification of different high-moisture fuels in sandwich gasification mode: a) woody biomass (pine); b) Powder River Basin coal, c) Illinois #6 coal, and d) turkey litter. Gasifier operation in nonsandwich or "typical" downdraft gasifier operation mode, as shown in temperature profiles b and c, has characteristically high temperature peaks, while sandwich gasification mode depicts a uniform temperature-flat temperature profile, resulting in effective tar cracking and providing an ability to prevent high-temperature clinker formation, as observed in a typical gasifier operation mode. As shown, the oxidation zone (OX-2) in a sandwich mode achieves complete carbon conversion unlike in the case of a typical downdraft gasifier requiring unconverted carbon removal from the low-temperature frozen reaction zone. Near-zero carbon and tar conversion in the sandwich gasifier helped achieve high-conversion efficiency.

I claim:

1. A mixed-mode gasification process for producing syngas comprising:

providing a fuel;

providing a gasifier having a fuel injection port, an ash or residue extraction port, an outer periphery, and at least the following zones: an evaporation and devolatilization zone, a first exothermic oxidation zone, a second exothermic oxidation zone, a third exothermic oxidation zone, a first endothermic reduction zone located directly next to and sandwiched between the first and second exothermic oxidation zones, and a second endothermic reduction zone located directly next to and sandwiched between the first and third exothermic oxidation zones, the first exothermic oxidation zone located on a side of the gasifier next to the fuel injection port and upstream from the first and second endothermic reduction zones, the second and third exothermic oxidation zones located on a side of the gasifier next to the ash or residue extraction port; and providing an aerodynamic propulsive device to transfer devolatilized products from the evaporation and devolatilization zone to the second and third exothermic oxidation zones.

2. The process of claim 1, wherein the evaporation and devolatilization zone is disposed in direct flow communication with the fuel injection port.

3. The process of claim 1, wherein the evaporation and devolatilization zone is located upstream of the first exothermic oxidation zone.

4. The process of claim 1, wherein the aerodynamic propulsive device is an ejector.

5. The process of claim 1, wherein an oxidizer or a carrier gas is used in the aerodynamic propulsive device to convey the devolatilized products.

6. The process of claim 5, wherein the oxidizer or the carrier gas is a hot gaseous product obtained from combusting of an auxiliary fuel.

7. The process of claim 5, wherein the oxidizer or the carrier gas is an oxidizer, and wherein the oxidizer is used to control a temperature of the second and/or the third exothermic oxidation zones to increase fuel conversion.

8. The process of claim 1, wherein a temperature of the second and the third exothermic oxidation zones is higher than a temperature of the first oxidation zone.

9. The process of claim 1, wherein the devolatilized products include volatiles and/or char.

10. The process of claim 1, wherein char particles are injected as a secondary fuel into the gasifier.

11. The process of claim 10, the process further comprising fluidizing the char particles above one or more grates disposed in flow communication with the second and/or the third exothermic oxidation zones.

12. The process of claim 1, wherein the fuel is selected from the group consisting of coal, biomass, black liquor, animal waste, food waste, industrial waste, automotive waste, and combinations thereof.

13. The process of claim 1, wherein char is extracted from the second and the third exothermic oxidation zones, and wherein the char is used as a sorbent in a packed bed for syngas contaminant removal.

14. The process of claim 13, wherein spent or contaminated char removed from the packed bed is used as at least a portion of the fuel.

15. The process of claim 1, wherein the process is characterized by zero residual carbon discharge.

16. The process of claim 1, the process further comprising recovering syngas, wherein the syngas is optionally utilized for the production of heat, electricity, gaseous fuels, liquid fuels, chemicals, or a combination thereof.

17. A mixed-mode gasification system comprising:

a gasifier having a fuel injection port, an ash or residue extraction port, an outer periphery, and at least the following zones: an evaporation and devolatilization zone, a first exothermic oxidation zone, a second exothermic oxidation zone, a third exothermic oxidation zone, a first endothermic reduction zone located directly next to and sandwiched between the first and second exothermic oxidation zones, and a second endothermic reduction zone located directly next to and sandwiched between the first and third exothermic oxidation zones, the first exothermic oxidation zone located on a side of the gasifier next to the fuel injection port and upstream from the first and second endothermic reduction zones, the second and third exothermic oxidation zones located on a side of the gasifier next to the ash or residue extraction port; and an aerodynamic propulsive device configured to transfer devolatilized products from the evaporation and devolatilization zone to the second and third exothermic oxidation zones.

18. The system of claim 17, wherein the aerodynamic propulsive device is an ejector.

19. The system of claim 17, the system further comprising one or more grates disposed in flow communication with the second and/or the third exothermic oxidation zones.

* * * * *